US007048364B2

(12) United States Patent
Haan et al.

(10) Patent No.: US 7,048,364 B2
(45) Date of Patent: May 23, 2006

(54) INK TANK

(75) Inventors: Maurice Johan Jozef Haan, Landgraaf (NL); Mark Pieter Jozef Pinckaers, Venlo (NL)

(73) Assignee: Oce-Technologies B.V., MA Venlo (NL)

( * ) Notice: Subject to any disclaimer, the term of this patent is extended or adjusted under 35 U.S.C. 154(b) by 0 days.

(21) Appl. No.: 10/606,839

(22) Filed: Jun. 27, 2003

(65) Prior Publication Data

US 2004/0046844 A1 Mar. 11, 2004

(30) Foreign Application Priority Data

Jun. 28, 2002 (EP) ..... 02078188

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS 5,583,549 A * 12/1996 Ujita et al. ..... 347/86
6,030,074 A * 2/2000 Barinaga ..... 347/85
6,161,927 A 12/2000 Long et al.
6,250,751 B1 6/2001 Whitney et al.
6,264,318 B1 7/2001 Oda et al.
6,554,402 B1 * 4/2003 Trafton et al. ..... 347/49
2001/0048457 A1 12/2001 Hara et al.
2003/0202062 A1 * 10/2003 Steinmetz et al. ..... 347/86

OTHER PUBLICATIONS

Patent Abstracts of Japan, vol. 013, No. 380 (M-863), Aug. 23, 1989 & JP 01 133749 A (Cannon Inc), May 25, 1989.
Patent Abstracts of Japan, vol. 018, No. 186 (M-1585), Mar. 30, 1994 & JP 05 345423 A (Cannon Inc), Dec. 27, 1993.
Patent Abstracts of Japan, vol. 2002, No. 02, Apr. 2, 2002 & JP 2001 270113 A (Seiko Epson Corp), Oct. 2, 2001.
Patent Abstracts of Japan, vol. 2002, No. 05, May 3, 2002 & JP 2002 001980 A (Seiko Epson Corp), Jan. 8, 2002.

* cited by examiner

*Primary Examiner*—Thinh Nguyen
(74) *Attorney, Agent, or Firm*—Birch, Stewart, Kolasch & Birch, LLP

(57) ABSTRACT

An ink tank including a casing having a front wall provided with a coupling, and a bag disposed in said casing and connected to said coupling, wherein the casing comprises a first shell including said front wall, and a second shell welded to the first shell.

12 Claims, 2 Drawing Sheets

INK TANK

This non-provisional application claims priority under 35 U.S.C. § 119(a) on Patent Application No. 02078188.6 filed in Europe on Jun. 28, 2002, which is herein incorporated by reference.

BACKGROUND OF THE INVENTION

1. Field of the Invention

The present invention relates to an ink tank comprising a casing having a front wall formed with a coupling, and a bag disposed in the casing and connected to the coupling.

2. Background Art

Several ink jet printers comprise an ink tank that has a comparatively large volume and is arranged to be stationary in the frame of the printer and is connected to a movable ink jet device through a flexible tube. In operation, ink supply to the ink jet device is achieved either by drawing ink out of the tank or by supplying air into the space inside of the casing but outside of the bag, so that the bag can be collapsed and the ink can be squeezed out. The supply of ink from the tank to the ink jet device may be assisted by gravitational forces. As an alternative, ink supply might be achieved through gravitational forces alone, provided that the casing can be vented. In any case, the bag prevents the ink from leaking out of the casing and/or from being dried out through contact with the air in the casing, whereas the casing prevents the bag from being damaged or squeezed and facilitates the handling of the ink tank. An example of an ink tank of this type is described in U.S. Pat. No. 6,264,318.

SUMMARY OF THE INVENTION

It is an object of the present invention to provide an ink tank that is easy to manufacture, and a method of manufacturing the same.

The ink tank according to the present invention comprises a first shell including a front wall, and a second shell welded to the first shell.

A method of manufacturing the ink tank of the present invention includes the steps of:

molding a first and a second shell, the first shell having a front wall with a coupling formed therein, and an open end opposite to the front wall;

connecting a bag to the coupling such that a rear portion of the bag projects out of the open end of the first shell;

fitting the second shell over the projecting portion of the bag; and welding the first and second shells together.

Since the first shell has an open end opposite to the front wall, it is possible to mold the coupling in the front wall, even when this coupling has a rather complicated structure, without causing any problems in withdrawing the molded shell from the mold. This greatly facilitates the manufacture of the casing formed with the coupling. Further, the bag may easily be connected to the coupling which is accessible through the open end of the first shell. Since the casing is completed and closed-off by welding the two shells together, with the second shell being fitted over the rear end of the bag, it is not necessary to provide any additional means for closing the casing.

The resulting ink tank has an integrated structure and cannot be re-opened, so that it is not possible to get access to the interior of the casing and to manipulate the bag. Since the two shells of the casing may be molded in almost any desired shape, it is possible to provide an ink tank which has an appealing design and one that satisfies practical needs.

When the two shells of the casing are connected by a continuous weld seam, it is possible to obtain an air-tight casing in which an elevated pressure can be generated for squeezing the ink out of the bag. In this case, a supply port for compressed air may preferably be molded in the second shell of the casing. On the other hand, when the ink is to be drained out of the bag by gravitational forces and, to this end, the casing has to be vented, the two shells may be welded together by spot-welding, so that minor gaps, which may serve as vent holes, remain at the seam between the two shells.

The bag is preferably accommodated in the casing in a U-shaped configuration, with both lateral portions of the bag being bent upwardly. In order to assist the bag in collapsing in the desired U-shape without forming undesired wrinkles, a wall-shaped collapsing induction fitment may be provided at the top wall of the first shell so as to extend into the interior of the casing. Then, when the bag is expanded, its top wall will fit around this fitment, so that the bag retains its U-configuration even in the expanded state, although it then almost fills the entire volume of the casing. When the bag collapses, it will reliably retain the U-shaped configuration which it already had in the expanded state.

Since the expansion and collapsing behavior of the bag is controlled by the walls of the casing and, as the case may be, by the collapsing induction fitment, the bag may be filled and emptied multiple times without any need for obtaining access to the interior of the casing, once the bag has been accommodated in the casing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
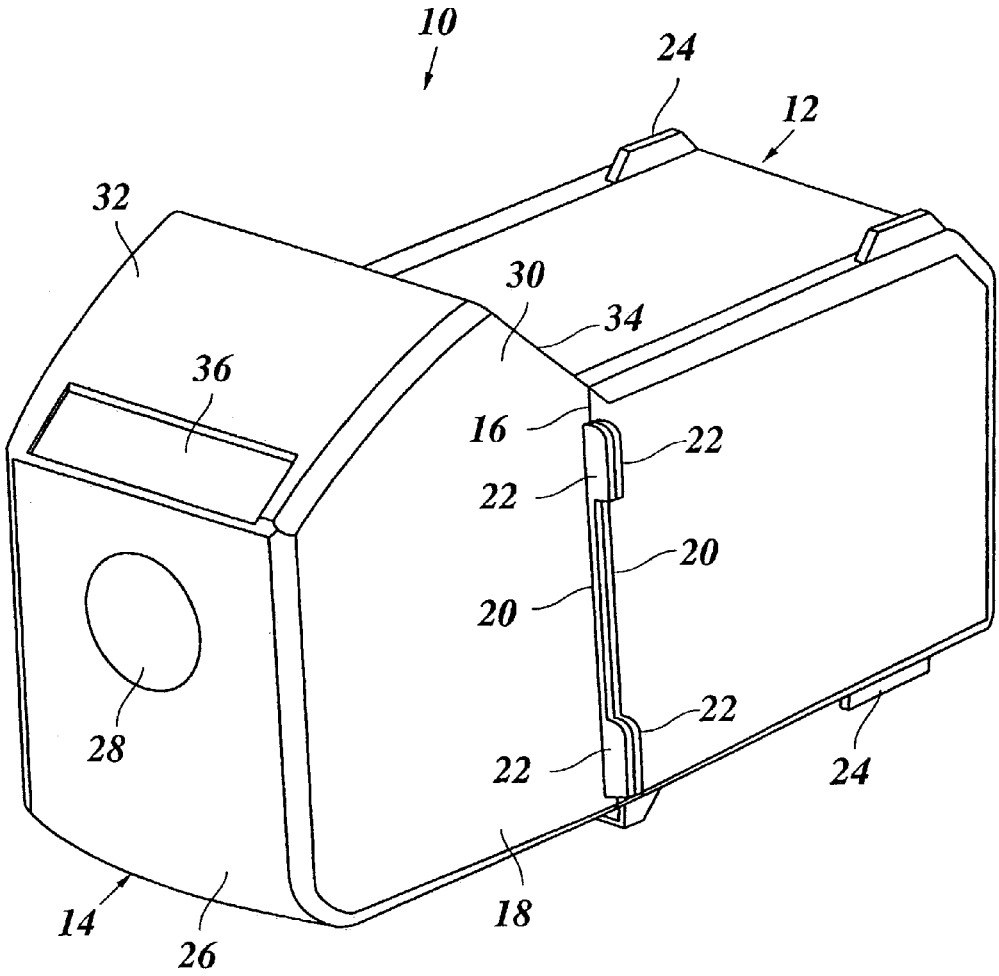
FIG. 1 is a perspective view of an ink tank according to the present invention.

The ink tank shown in FIG. 1 has a box-like casing 10 made of a synthetic resin. The casing comprises a first shell 12 and a second shell 14 which are both obtained through injection molding and are fitted together at a seam 16 which passes substantially vertically through the side walls 18 of the casing and bisects the casing into approximately two halves.

On the outer surfaces of the side walls 18, the first and second shells 12, 14 are formed with mating flanges 20 which extend along the seam 16 and engage each other in the plane of the seam 16. These flanges 20 serve to improve the rigidity of the side walls 18 and each flange has two outwardly projecting ears 22 which are fixed to one another by spot-welding so as to form the two shells 12, 14 into an integral structure.

The first shell 12 has guide rails 24 projecting from its top and bottom surfaces. These guide rails 24 serve to guide the casing 10 when the same is inserted into a socket (not shown) of an ink jet printer in order to connect the ink tank to the ink supply system of the printer.

In the second shell 14, the rear wall 26 of the casing is provided with a lens-shaped depression 28. In order to disengage the casing 10 from the socket of the printer, the casing 10 must be pushed forwardly and upwardly. To this end, a user may engage his finger into the depression 28.

On the top side, the second shell 14 has a roof-shaped portion 30 which is limited on the top side by an upwardly sloping wall 32 and a downwardly sloping wall 34. A shallow rectangular recess 36 in the upwardly sloping wall 32 is intended for accommodating a tag which may be used for example for indicating the type and color of the ink contained in the tank.

Figure 2:
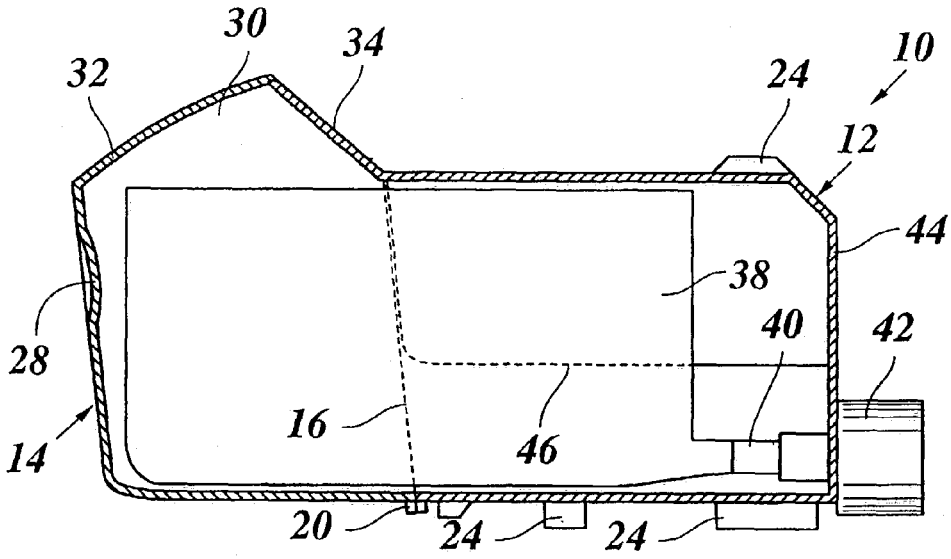
FIG. 2 is a longitudinal section through the casing of the ink tank.

As is shown in FIG. 2, the casing 10 accommodates a bag 38 made of flexible liquid-tight material and filled with ink. A spout 40 formed in the front lower edge of the bag 38 is connected to a coupling 42 which penetrates a front wall 44 of the first shell 12 and is molded integrally with the first shell. Thus, when the ink tank has been inserted in the socket of the printer, the coupling 42 connects to the ink supply system of the printer, so that the ink may be withdrawn from the bag 38. This will cause the bag 38 to collapse, and since the seam 16 is not air-tight, the interior of the casing 10 is vented through minor gaps formed at the seam 16.

As is further shown in FIG. 2, the first shell 12 is formed with an internal wall 46 which extends from the top wall into the interior of the casing and is arranged in a longitudinal median plane of the casing. The wall 46 forms a fold in the bag 38, so that the lateral portions of the bag 38 are bent upwardly around the wall 46. When the ink is withdrawn from the bag, the bag collapses into a sheet-like configuration, and the wall 46 induces the collapsing of the bag in such a manner that it will retain a U-shaped configuration with the lateral portions of the bag 38 being bent upwardly. When the bag 38 is refilled with ink through the coupling 42, the bag is expanded again so that it fills the interior of the casing 10 around the wall 46.

Coupling 42 comprises a valve mechanism that prevents the leaking out of the ink when bag 38 is filled with ink and enables the bag 38 to be refilled again with ink. The coupling only has one connection for ink and due to the construction of the ink tank and casing no extra coupling for the inlet or outlet of air is needed. When, during the process of filling, the bag 38 expands and the air from the interior of the casing 10 is pressed out through the non-airtight seam 16.

Figure 3:
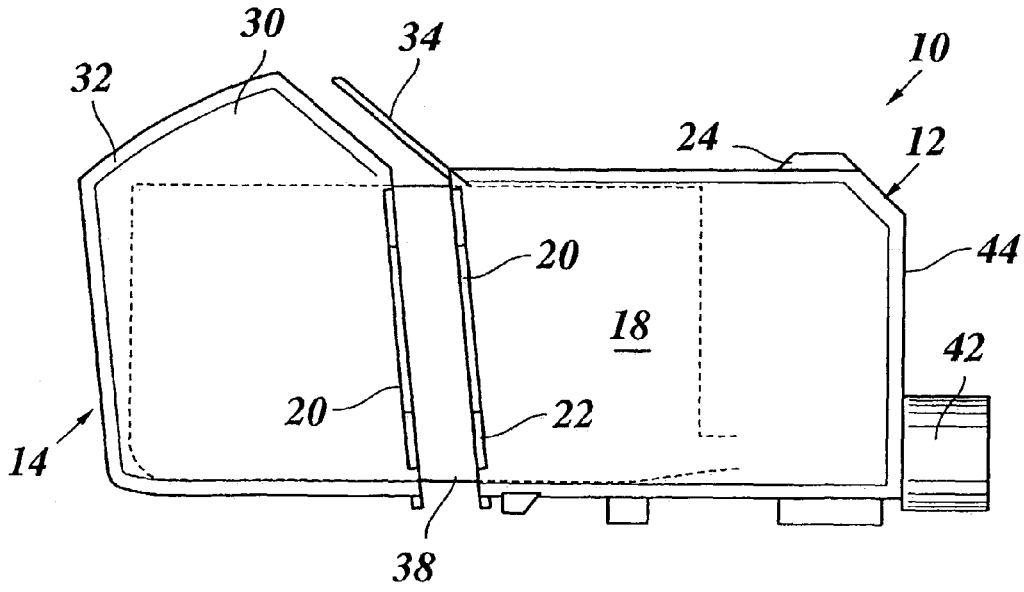
FIG. 3 is an exploded side elevation showing two shells forming a casing of the ink tank.

As is shown in FIG. 3, the downwardly sloping wall 34 of the roof-shaped portion 30 is formed integrally with the first shell 12, so that the top leg of the seam 16 extends along the top corner between the walls 32 and 34. As a result, the second shell 14 has an open end facing towards the front side of the casing 10 without forming any undercuts, so that the second shell may readily be removed from the mold in the injection molding process. Similarly, the first shell 12 is flared towards an open end opposite to the front wall 44. Thus, both shells 12, 14 can easily be formed by injection molding.

When the first and second shells 12, 14 have been molded, the bag 38 is inserted into the first shell 12 from the open rear end thereof and is connected to the coupling 42. Then, the second shell 14 is fitted over the projecting rear end of the bag 38, as is shown in FIG. 3. Finally, the shells 12, 14 are fixedly connected with one another by spot welding at the ears 22, e.g. by means of an ultrasonic welding tong.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink tank comprising a casing having a front wall provided with a coupling, and a bag disposed in said casing and connected to said coupling, wherein the casing comprises a first shell including the entirety of said front wall, and a second shell welded to the first shell said casing having a box-like configuration and the first and second shells are fitted together at a seam which passes substantially through the center of side walls of the casing in a plane essentially in parallel with the front wall.

2. The ink tank according to claim 1, wherein each of the first and second shells has a flange extending along the seam.

3. The ink tank according to claim 2, wherein the first and second shells are spot-welded at the flanges.

4. The ink tank according to claim 1, wherein the first and second shells are injection-molded parts.

5. A method of manufacturing an ink tank including a casing having a front wall formed with a coupling, and a bag disposed in said casing, which comprises:

molding a first shell and a second shell, the first shell having said front wall with said coupling formed therein and an open end opposite the front wall;

connecting the bag to the coupling, such that a rear portion of the bag projects out of the open end of the first shell;

fitting the second shell over the projecting portion of the bag; and welding the first and second shells together.

6. The method according to claim 5, wherein the first and second shells are welded together by ultrasonic welding.

7. The method according to claim 5, wherein the first and second shells are welded together by spot-welding.

8. A method of filling an ink bag disposed in a casing having a front wall formed with a coupling connected to the bag, the casing further containing a first shell including said front wall and a second shell welded to the first shell into a box-like configuration, with the shells being fitted together at a seam which passes essentially through the center of the side walls of the casing in a plane substantially parallel with the front wall, each of the first and second shells having at least one flange extending along the seam and the shells are spotwelded at these flanges, which comprises introducing the ink from outside the container through the coupling into the bag whereby the air pressure within the casing outside the bag is maintained in equilibrium with the air pressure outside the casing.

9. An ink tank comprising a casing having a front wall provided with a coupling, and a bag disposed in said casing and connected to said coupling, wherein the casing comprises a first shell including the entirety of said front wall, and a second shell welded to the first shell, and wherein the second shell has a roof-shaped top portion delimited by an upwardly sloping wall formed integrally with the second shell and a downwardly sloping wall formed integrally with the first shell and projecting from a rear end of a top wall thereof.

10. An ink tank comprising a casing having a front wall provided with a coupling, and a bag disposed in said casing and connected to said coupling, wherein the casing comprises a first shell including the entirety of said front wall, and a second shell welded to the first shell, and wherein the first shell has an internal wall which projects downwardly from the top wall into the interior of the casing and is positioned in a longitudinal median plane of the casing.

11. An ink tank comprising a casing having a front wall provided with a coupling, and a bag disposed in said casing and connected to said coupling, wherein the casing comprises a first shell including the entirety of said front wall, and a second shell welded to the first shell, and wherein a supply port for compressed air is provided in the second shell of the casing.

12. An ink tank comprising a casing having a front wall provided with a coupling, and a bag disposed in said casing and connected to said coupling, wherein the casing comprises a first shell including the entirety of said front wall, and a second shell welded to the first shell, and wherein the coupling is integral with the front wall.

* * * * *